US009617130B2

(12) United States Patent
Crumpler, Jr.

(10) Patent No.: US 9,617,130 B2
(45) Date of Patent: Apr. 11, 2017

(54) MECHANICAL SCISSOR LIFT

(71) Applicant: HVAC—Jack, L.L.C., Wichita, KS (US)

(72) Inventor: Howard Dean Crumpler, Jr., Wichtia, KS (US)

( * ) Notice: Subject to any disclaimer, the term of this patent is extended or adjusted under 35 U.S.C. 154(b) by 0 days.

(21) Appl. No.: 15/017,181

(22) Filed: Feb. 5, 2016

(65) Prior Publication Data

US 2016/0176688 A1 Jun. 23, 2016

(51) Int. Cl.
*B66F 7/06* (2006.01)

(52) U.S. Cl.
CPC ..... *B66F 7/0608* (2013.01); *B66F 7/0625* (2013.01); *B66F 7/0666* (2013.01)

(58) Field of Classification Search
CPC ..... B66F 7/0608; B66F 7/0625; B66F 7/0666
USPC ..... 254/432, 122, 124, 126
See application file for complete search history.

(56) References Cited

U.S. PATENT DOCUMENTS 2,363,784 A * 11/1944 Valentine ..... B66C 23/34 182/141
3,003,746 A * 10/1961 Gridley ..... B66F 7/0625 187/243
3,785,462 A 1/1974 Coad et al.
3,982,718 A * 9/1976 Folkenroth ..... A61G 15/02 187/269
4,113,065 A 9/1978 Sikli
4,241,540 A 12/1980 Depperman
4,405,116 A * 9/1983 Eisenberg ..... B66F 7/0608 182/141
4,690,606 A 9/1987 Ross
4,712,653 A 12/1987 Franklin et al.
4,744,712 A 5/1988 Mitchell
5,339,749 A * 8/1994 Hirose ..... B23Q 1/5468 108/137
5,379,855 A * 1/1995 Juang ..... B66B 9/02 187/269
5,531,557 A 7/1996 Springer
5,716,040 A * 2/1998 Torres ..... B66F 7/0608 254/88
6,044,927 A 4/2000 Newlin
(Continued)

FOREIGN PATENT DOCUMENTS

EP 0121348 A1 10/1984
WO WO9420405 9/1994
WO WO2011150525 12/2011

*Primary Examiner* — George Nguyen
(74) *Attorney, Agent, or Firm* — Kenneth H. Jack; Davis & Jack, L.L.C.

(57) ABSTRACT

A scissor lift incorporating a trolley; lateral and oppositely lateral rollers; axles positioning the rollers at lateral and oppositely lateral sides of the trolley; torque cancelling "C" brackets mounted upon the trolley's lateral and oppositely lateral sides; a jack screw actuator connected operatively to the trolley for alternatively longitudinally and oppositely longitudinally moving the trolley; lateral and oppositely lateral roller tracks having longitudinal edges, each of the tracks supporting one of the rollers and each of the "C" brackets engaging one of the longitudinal edges; a scissor arm matrix having a lower longitudinal end connected to the trolley; a platform attached to the scissor arms' upper end; and a motor connected operatively to a chassis for longitudinally moving the jack screw actuator and for vertically moving the platform.

16 Claims, 3 Drawing Sheets

(56) References Cited

U.S. PATENT DOCUMENTS

| | | | | |
|---|---|---|---|---|
| 6,161,438 | A | 12/2000 | Mullet et al. | |
| 6,651,775 | B2 | 11/2003 | Bassett, Jr. | |
| 6,761,248 | B1 | 7/2004 | Harbison | |
| 7,055,802 | B1 | 6/2006 | Jones et al. | |
| 7,093,691 | B1 * | 8/2006 | Vaughan | B66B 9/0815 108/106 |
| 7,690,473 | B2 | 4/2010 | Hammonds | |
| 7,810,788 | B2 | 10/2010 | Devries | |
| 8,505,684 | B1 | 8/2013 | Bogue | |
| 8,733,508 | B2 | 5/2014 | Bacon | |
| 8,827,246 | B2 | 9/2014 | Swasey et al. | |
| 2003/0075657 | A1 * | 4/2003 | Joubert | B66F 7/0608 248/277.1 |
| 2003/0189194 | A1 * | 10/2003 | Latvys | B66F 7/08 254/9 C |
| 2006/0180403 | A1 * | 8/2006 | Hanlon | B66B 9/0815 187/269 |
| 2014/0103277 | A1 * | 4/2014 | Cormack | B66F 7/065 254/89 R |

* cited by examiner

MECHANICAL SCISSOR LIFT

FIELD OF THE INVENTION

This invention relates to mechanical scissor lifts which are adapted for raising and lowering heavy equipment such as heating and air conditioning units from, for example, ground levels to commercial building rooftops.

BACKGROUND OF THE INVENTION

Conventionally configured scissor lift mechanisms are commonly mechanically complex, are unduly bulky, and commonly lack a capacity for configuration for compact storage.

The instant inventive scissor lift solves or ameliorates problems and challenges discussed above by incorporating within a scissor lift mechanism specialized trolley, jack screw assembly, and chassis elements which facilitate smooth and reliable powered scissor lifting action while protecting screw threads from damage, enabling a compact storage configuration, and reducing mechanical complexity, weight and bulk of the machine.

BRIEF SUMMARY OF THE INVENTION

A first structural component of the instant inventive scissor lift comprises a longitudinally movable trolley having lateral and oppositely lateral sides (or right and left sides) and having longitudinal and oppositely longitudinal ends. In a preferred embodiment, the invention's trolley component is composed of aluminum plate or sheet metal and is substantially rectangular or square.

Further structural components of the instant inventive scissor lift comprise pair of or lateral and oppositely lateral rollers. Mounting means for respectively positioning the lateral and oppositely lateral rollers at the trolley's lateral and oppositely lateral sides are preferably provided. In a preferred embodiment, the rollers' mounting means comprise lateral and oppositely lateral journal axles which are fixedly attached to and respectively extend laterally and oppositely laterally from the trolley's lateral and oppositely lateral sides. Suitably, the roller mounting means may alternatively comprise a single transverse axle which spans laterally across the trolley. Where the invention's rollers alternatively comprise ball bearings or cylindrical bearings, the mounting means may suitably alternatively comprise a capture cavity or channel which retains such rollable members for longitudinal movement along bearing races. In the preferred embodiment, journal axle mounting means position wheel configured rollers at longitudinal ends of the trolley's lateral and oppositely lateral sides.

Further structural components of the instant inventive scissor lift comprise lateral and oppositely lateral "C" brackets which, like the lateral and oppositely lateral rollers, are respectively mounted upon the trolley's lateral and oppositely lateral sides. Where the rollers' mounting means position the rollers at the longitudinal end of the trolley, the lateral and oppositely lateral "C" brackets are preferably oppositely longitudinally positioned upon the trolley.

A further structural component of the instant inventive scissor lift comprises a jack screw assembly which incorporates a helically threaded shaft and helically threaded nut combination. In the preferred embodiment, such jack screw assembly is compactly mounted for operation within a lower chassis component of the scissor lift. Within such chassis, the jack screw assembly preferably connects operatively to the trolley for alternatively longitudinally and oppositely longitudinally driving and drawing the trolley. In a preferred embodiment, the jack screw assembly's helically threaded shaft is fixed against longitudinal movement within the chassis frame. Correspondingly, the preferably provided helically threaded nut component of such assembly is non-rotatably mounted upon the trolley for concurrent longitudinal movement along the helically threaded shaft.

In a suitable, though less desirable, structural alternative, the jack screw assembly's helically threaded shaft component may be non-rotatably mounted to the trolley for concurrent longitudinal movement while a rotatable and longitudinally fixed internally helically threaded coupling nut or sleeve receives such shaft. Turning and counter-turning of such coupling nut may similarly longitudinally drive and draw the shaft and attached trolley within the chassis.

The base frame or chassis component of the instant inventive scissor lift preferably forms a longitudinally oblongated rectangle, and comprises lateral and oppositely lateral track surfaces which rollably support the trolley's lateral and oppositely lateral rollers. In a preferred embodiment, each of the roller tracks presents a longitudinally extending edge which is positioned inwardly with respect to the chassis. In operation, such longitudinally extending edges act as slide ridges which nestingly extend into the "C" brackets' openings for which slidably guiding and restricting the motions of the "C" brackets and the trolley with respect to the chassis. Suitably, the roller tracks' longitudinally extending edges may present at other surfaces and locations on and about the roller tracks, the "C" brackets being consonantly re-oriented for sliding engagements with such alternative edges.

Further structural components of the instant inventive scissor lift comprise a vertical matrix of scissor arms or pivoting "X" configured arms, such matrix having upper and lower ends. Scissor arm leg ends at a lower and preferably longitudinal end of such matrix are pivotally mounted for motion with the trolley, while the matrix's longitudinally opposite scissor arm lower leg ends are pivotally and longitudinally immovably attached to the chassis' oppositely longitudinal end.

A further structural component of the instant inventive scissor lift comprises a load platform which is fixedly attached to the scissor arm matrix's upper end. In a preferred embodiment, the load platform component is rectangular; is composed of lightweight aluminum; and is sized for raising and lowering heavy equipment such as commercial heating and air conditioning units.

A further structural component of the instant inventive scissor lift comprises turning means which are connected operatively for rotating a preferably longitudinally fixed element of the jack screw assembly. Where, as is preferred, the jack screw assembly's helically threaded nut moves longitudinally with the trolley component, the turning means are connected operatively to the assembly's helically threaded shaft component. Suitably, the turning means may comprise a hand turnable crank, a pneumatic motor, or a hydraulic motor. However, the turning means preferably comprise a reversible electric motor which is rigidly mounted by motor support brackets within the oppositely longitudinal end of the scissor lift's chassis.

In operation of the inventive scissor lift, turning and counter-turning actuations of the preferably provided electric motor turning means rotate the jack screw assembly's jack screw, such rotations simultaneously driving or drawing helically threaded nut and trolley assembly longitudinally along the chassis. During such screw actuated trolley motion, load imbalances, or imbalances in pivot joint frictional forces existing between the lift's lateral and oppositely lateral sides may be experienced. Without the protective structures of the instant invention, such imbalances may be translated by the scissor arm matrix to lower leg ends and to the rollably guided trolley, causing such forces to undesirably produce screw thread jamming torsional moments at the helically threaded nut. However, according to the operation of the instant invention, one of the trolley's specially provided lateral and oppositely lateral "C" brackets will simultaneously engage one of the roller track longitudinal edges to produce a counter-torque moment about the vertical axis, such "C" bracket contact advantageously nullifying such screw damaging torsional forces. Undesirable and potentially screw thread jamming torsional forces about the trolley's lateral axis are also advantageously cancelled by the engagements of the "C" brackets with the roller tracks' longitudinal edges.

Accordingly, objects of the instant invention include the provision of a scissor lift mechanism which incorporates structures, as described above, and which arranges such structures in relation to each other in manners described above, for the achievement of the beneficial functions described above.

Other and further objects, benefits, and advantages of the instant invention will become known to those skilled in the art upon review of the Detailed Description which follows, and upon review of the appended drawings.

DETAILED DESCRIPTION OF A PREFERRED EMBODIMENT

Figure 1:
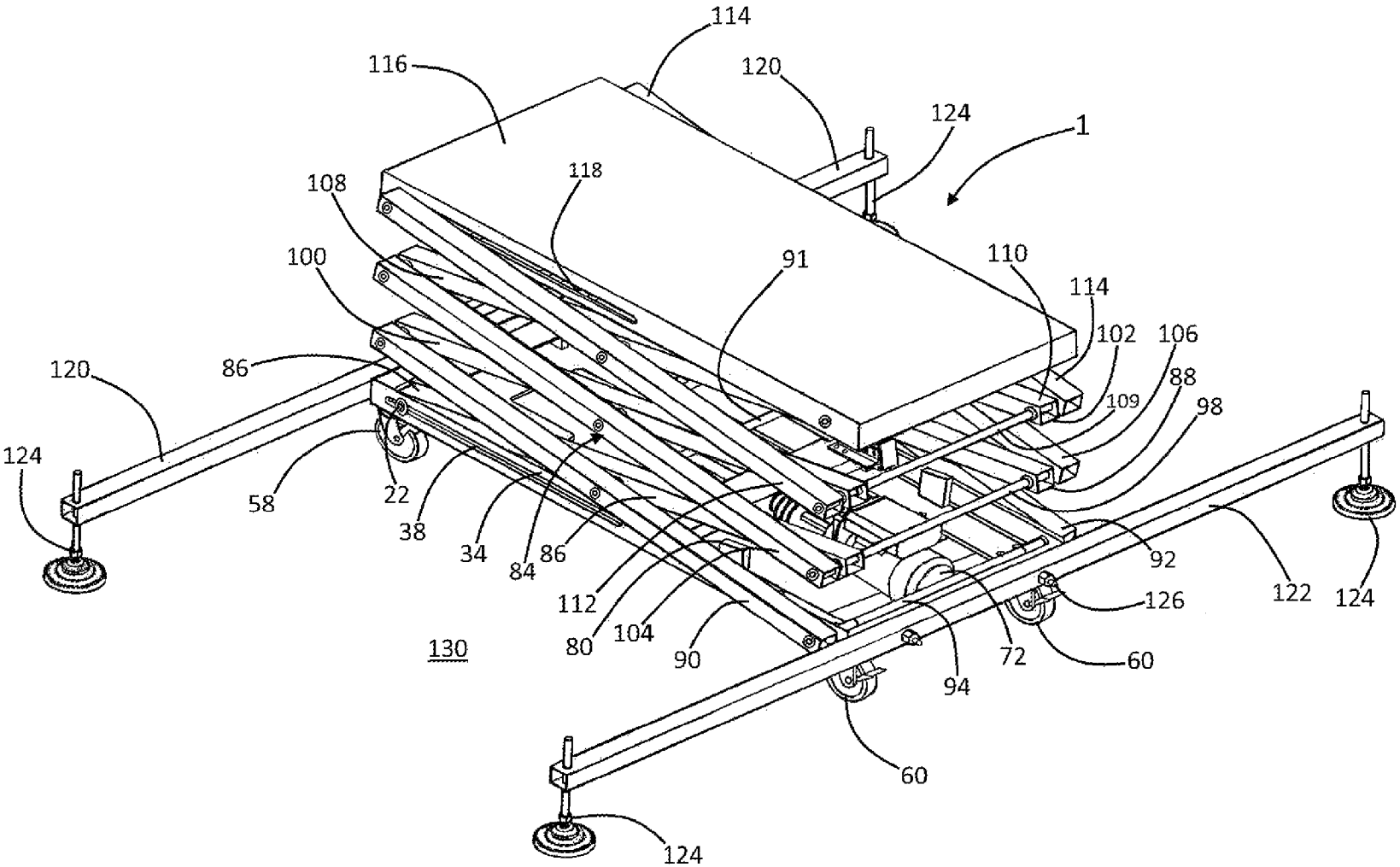
FIG. 1 is a perspective view of a preferred embodiment of the instant inventive scissor lift.
Figure 2:
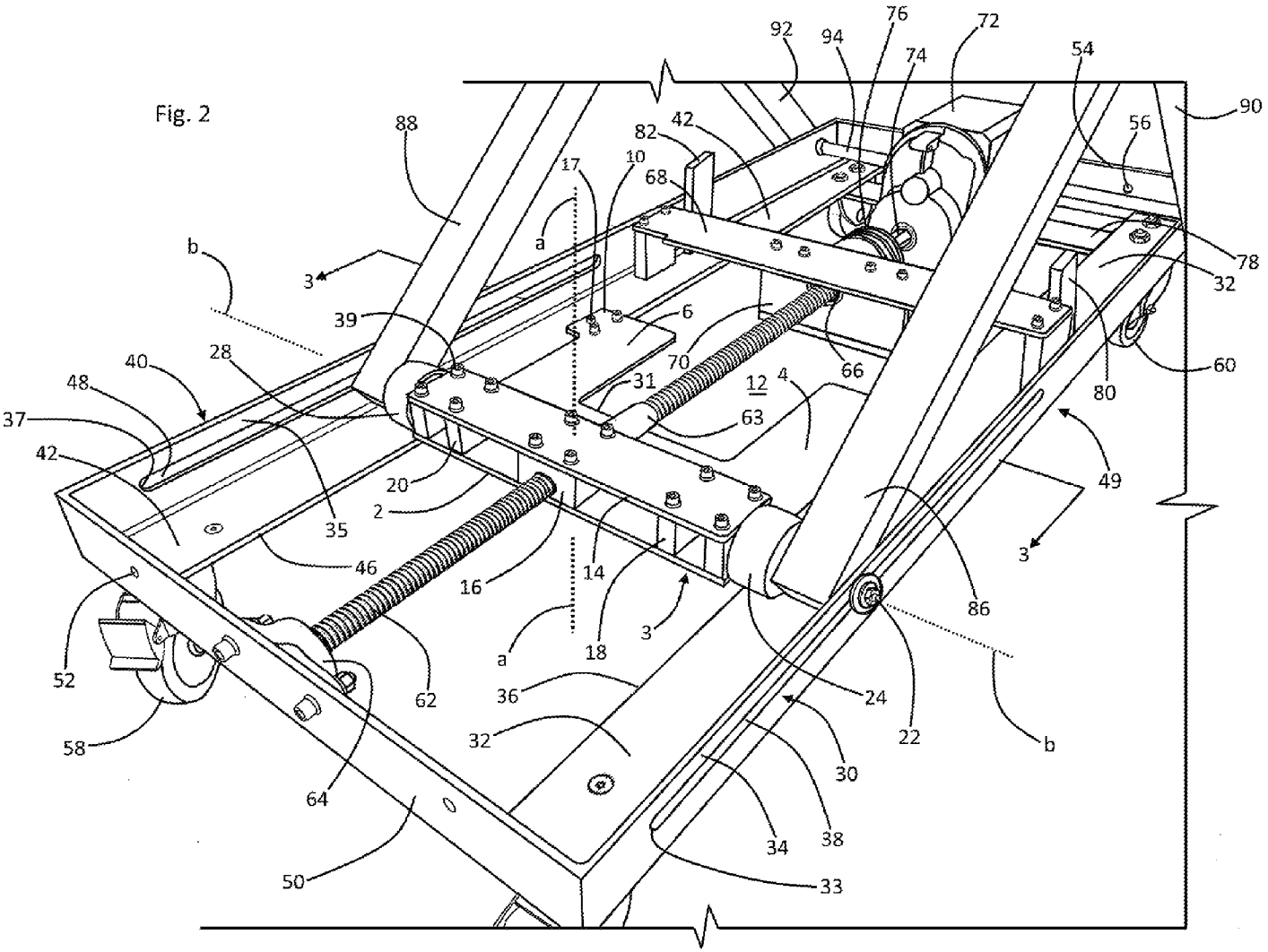
FIG. 2 is an alternative partial perspective view of the scissor lift of FIG. 1.
Figure 3:
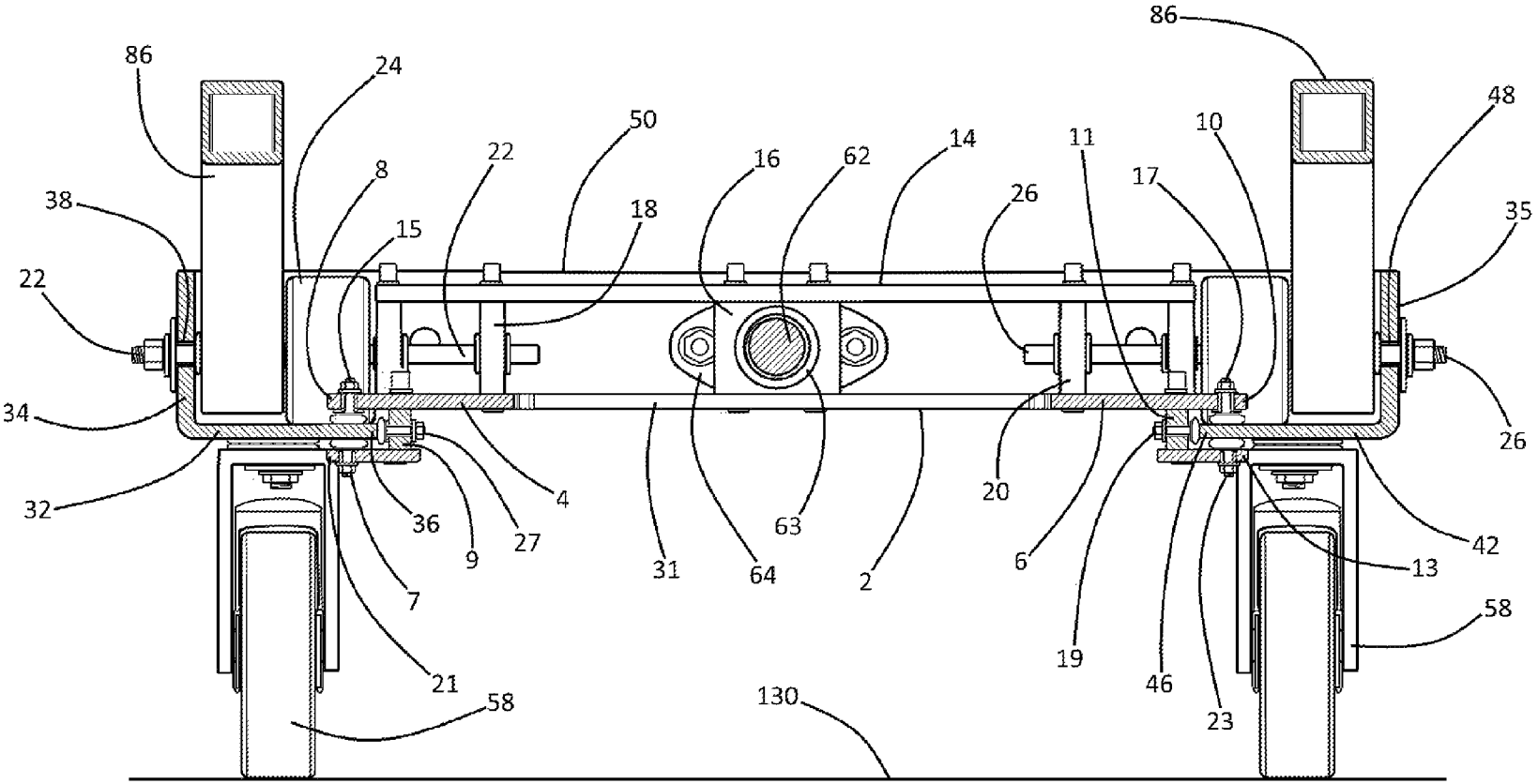
FIG. 3 is a sectional view, as indicated in FIG. 2.

Referring now to the drawings and in particular to Drawing FIG. 1, a preferred embodiment of the instant inventive scissor lift is referred to generally by Reference Arrow 1. Referring further simultaneously to FIGS. 2 and 3, the scissor lift 1 comprises a trolley which is referred to generally by Reference Arrow 3, the trolley 3 having lateral and oppositely lateral sides. According to example of FIGS. 1 and 2, the lateral side of the trolley 3 is toward the viewer, and in view of FIG. 3, such lateral side is positioned leftwardly. The trolley 3 also has a longitudinal end which, in the example of FIG. 2, is oriented toward the viewer.

The trolley 3 preferably comprises a square or rectangularly configured aluminum plate 2 having a "U" configured oppositely longitudinal end, the multiple functions of which are further discussed below. In forming its "U" configuration, the plate 2 of the trolley 3 preferably incorporates lateral and oppositely lateral arms 4 and 6, each such arm having a distal or oppositely longitudinal end. The traverse longitudinal portion 31 of plate 2 in combination with the arms 4 and 6 peripherally defines an oppositely longitudinally opening motor support bracket receiving space 12.

The trolley 3 preferably further comprises an upper retainer plate 14 which interstitially captures and securely holds lateral and oppositely lateral axle mounting blocks 18 and 20, and a substantially centrally positioned helically threaded coupling nut 16. A plurality of helically threaded bolts 39 which extend through the nut 16 and through the axle mount blocks 18 and 20, and securely capture those structures between plates 2 and 14.

Further structural components of the instant inventive scissor lift comprise lateral and oppositely lateral rollers 24 and 28. The rollers are rotatably secured upon the trolley 3 by rotatable mounting means which respectively position the rollers at the trolley's lateral and oppositely lateral sides. The invention's rotatable mounting means preferably comprise lateral and oppositely lateral journal or stub axles 22 and 26 which are respectively secured within axle ports within the axle mount blocks 18 and 20. The axles 22 and 26 are intended as being representative of other commonly known means for mounting rollers such as the wheel configured rollers 24 and 28, such means including an alternative solid transverse axle (not depicted within views). Where the invention's rollers alternatively comprise ball bearings or cylindrical bearings (not depicted within views), the mounting means may correspondingly comprise capture cavities or channels which rollably receive and guide such bearings along longitudinal bearing races.

Referring in particular to Drawing FIGS. 2 and 3, it may be seen that the distal end of the oppositely lateral arm 6 of the trolley 3 forms an oppositely laterally extending tab or arm extension 10. Such arm extension 10 overlies an arm extension 13 which is rigidly suspended by a spacer bar 11. The view of FIG. 3 shows that the arms 10 and 13 in combination with the spacer 11 figuratively form a letter "C" or an oppositely laterally opening "C" channel or bracket. Consistently with the structure of capital letter "C", arms 10 and 13 reflect the upper and lower arms of such letter, and the spacer 11 reflects the column portion of such letter. Laterally extending arms 7 and 8 and spacer 9 presented at and mounted upon the distal end of the lateral trolley arm 4 similarly form and define a lateral "C" bracket component.

A further structural component of the instant inventive scissor lift comprises a jack screw assembly which incorporates an externally helically threaded shaft 62 and the helically threaded coupling nut 16 which receives such threaded shaft. The helically threaded shaft 62 and nut 16 combination depicted in FIG. 2 is intended as being representative of a mechanically inverted jack screw actuator (not depicted within views) which incorporates a non-rotating trolley mounted screw shaft in combination with a longitudinally fixed and rotatable threaded nut or screw sleeve.

As is shown in FIG. 2, the preferred jack screw assembly is connected operatively to the trolley 3 by means of the bolted placements of plates 2 and 14, and is further connected operatively to a rectangular chassis component which is referred to generally by Reference Arrow 49. In its operative connection to the chassis 49, the longitudinal end of helically threaded shaft 62 is mounted rotatably upon a chassis cross-member 50 by means of a rotary bearing 64. The oppositely longitudinal end of the helically threaded shaft 62 is similarly rotatably supported by bearing 62 which is supported by motor support bracket elements 68, 70, and 78. Assuming, for the sake of example, that screw shaft 62 is right-handed, clockwise turning (from the prospective of FIG. 3) draws the trolley 3 oppositely longitudinally within chassis 49, and counter-clockwise turning alternatively longitudinally drives the trolley 3.

The chassis 49 preferably comprises lateral and oppositely lateral "L" beams which are referred to generally by Reference Arrows 30 and 40. Each of the "L" beams 30 and 40 preferably comprises a horizontal web section (i.e., sections 32 and 42), and a vertically extending flange section (i.e., sections 34 and 35). Upper surfaces of the "L" beams' web sections 32 and 42 advantageously serve as tracks which rollably support the trolley's rollers 24 and 28.

The lateral and oppositely lateral "L" beams' webs 32 and 42 preferably present longitudinally extending and inwardly facing edges 36 and 46, such edges being respectively received within the laterally and oppositely laterally opening "C" brackets 7,8,9, and 10,11,13. Accordingly, such edges and brackets function as motion guiding and pivot restricting slide ridge and slide channel combinations.

The longitudinally extending edges 36 and 46 depicted in FIGS. 2 and 3 are intended as being representative of other edge surfaces which may be presented upon or formed within the "L" beams' webs 32 and 42. For example, such alternatively configured longitudinally extending edges may suitably comprise side walls or edges of longitudinally extending slots (not depicted within views) which open at webs 32 and 42. Upon adoption of such alternatively configured longitudinally extending edges, the lateral and oppositely lateral "C" brackets may be re-oriented for sliding captures of such edges.

Referring in particular to FIG. 3, the lateral and oppositely lateral nesting receipts of "L" beam edges 36 and 46 within the openings of "C" brackets 7,8,9, and 10,11,13, are preferably slidably augmented by vertically paired lateral nylon plastic pads 15 and 21 and by vertically paired oppositely lateral nylon plastic pads 17 and 23. To further enhance the sliding motion of the lateral and oppositely lateral "C" brackets along the "L" beam edges 36 and 46, laterally and oppositely laterally facing nylon pads 27 and 19 are respectively mounted upon spacers 9 and 11. Each of the nylon slide pads 15, 21, 27, 17, 19, and 23 is preferably mounted by means of a helically threaded bolt and nut combination for adjustability of sliding contact pressure.

The instant inventive scissor lift 1 preferably further comprises a scissor arm matrix which is referred to generally by Reference Arrow 84. As depicted in FIG. 1, the scissor arm matrix 84 comprises lateral crossing or "X" configured scissor arms 86 and 90, 100 and 104, and 108 and 112, and comprises oppositely laterally crossing or "X" configured scissor arms 88 and 92, and 110 and 106, along with a third and uppermost "X" configured scissor arm pair including scissor arm 114. The six pairs of "X" configured scissor arms in the Example of the drawings are intended as being representative of lesser and greater numbers of such scissor arms.

Each of the pivot joints which interconnect the scissor arm pairs preferably includes a laterally extending axle bar of which bars 91, 94, 98, and 109 are examples. Such lateral axle bars dually serve as hinge pins and as stiffening members which lessen sway and matrix deformation upon full upward extension of the scissor lift.

As shown in FIG. 2, the lower ends of scissor arms 90 and 92 are preferably longitudinally fixed at the oppositely longitudinal end of chassis 49 for rotation about hinge pin/axle 94, while the lower ends of scissor arms 86 and 88 are both pivotally and longitudinally movably mounted upon the lateral and oppositely lateral extensions of the trolley's axles 22 and 26.

In operation of the scissor arm matrix 84, the lowermost lateral and oppositely lateral "X" pairs of scissor arms (i.e., scissor arm pairs 86, 90 and 88, and 92) are capable of pivoting flexion and extension motions. FIG. 1's configuration of the lift 1 represents partial pivoting extensions of the scissor arms, and FIG. 2 alternatively represents pivoting flexions of the scissor arms. The above discussed oppositely longitudinal motion of the trolley 3 within chassis 49 actuates such arm flexion motions, and a returning longitudinal motion of the trolley actuates the pivoting extension motions. Overlying "X" pairs of scissor arms correspondingly flex and extend, and the upper longitudinal ends of arms 112 and 114 slidably move within travel slots 118 in response to the flexions and extensions. Accordingly, reciprocating oppositely longitudinal and longitudinal motions of the trolley 3 within chassis 49 alternatively raise and lower the scissor arm matrix 84 and the load platform 116.

In order to resist excess longitudinally directed strain exerted by the helically threaded coupling nut 16 against the threads of shaft 62 upon a placement of a heavy load (including, for example, a heating or air conditioning unit) upon the lowered platform 116 (i.e., the FIG. 1 position) lateral and oppositely lateral extension stopping pedestals 80 and 82 are provided, the upper surfaces of such pedestals respectively bearing against undersurfaces of the oppositely longitudinal ends of scissor arms 86 and 88 upon maximal pivoting extensions of such arms. In the preferred embodiment, axles 22 and 26 bear against the extreme longitudinal ends 33 and 37 of travel slots 38 and 48 simultaneously with such contacts of arms 86 and 88 against pedestals 80 and 82. Such simultaneous contacts advantageously initially bypass triangulating loading against the nut 16, and allow workers to stand upon the lowered platform 116 while initially positioning a maximal load thereon.

In addition to serving as scissor arm extension stops, the travel slots 38 and 48 within "L" beam flanges 34 and 35 advantageously allow the lower longitudinal ends of arms 86 and 88 to be supported upon axles 22 and 26 in stable "double shear" fashions.

A further structural component of the instant inventive scissor lift 1 comprises turning means which are connected operatively to the jack screw assembly 16,62. The turning means preferably comprises a reversible electric motor 72 whose output shaft 74 supplies rotary power to the helically threaded shaft 62 by means of a rotary connector 76. The two way electric motor 72 is intended as being representative of other suitably substituted turning means, such as a manually turnable crank, a pneumatic motor, or a hydraulic motor (not depicted within views). Upon clockwise turning of the helically threaded shaft 62, and upon resultant oppositely longitudinal travel of the trolley 3 and corresponding flexion of "X" scissor arms 86 and 90, and 88 and 92, motor support bracket member 70 compactly enters and nests within the "U" space 12 formed between trolley's arms 4 and 6. A stop sleeve 63, which is mounted upon the oppositely longitudinal end of the helically threaded nut 16 and which extends concentrically along the screw shaft 62, has an oppositely longitudinal end which is positioned slightly oppositely longitudinally from the transverse edge 31 of the "U" bracket. Such excess oppositely longitudinal extension of the stop sleeve with respect to the transverse edge 31 advantageously assures that oppositely longitudinal travel of the trolley 3 is stopped by contact of the stop sleeve 63 with bearing 66 and/or bracket member 70. The instant invention's specialized "U" configuration of the trolley 3 dually and simultaneously functions as an oppositely longitudinally extended torque cancelling component (whose function is further discussed below) and as spatially compact non-extended component.

To further enhance stability of the inventive scissor lift 1 upon its full upward extension, longitudinal and oppositely longitudinal outriggers 120 and 122 are provided, the longitudinal outrigger 120 being mounted to chassis crossbar 50 via bolts extending through bolt eyes 52, and the oppositely longitudinal outrigger 122 being similarly mounted upon chassis cross-member 54 by bolts 126 which extend through bolt eyes 56. Vertically adjustable feet 124 at the extreme lateral and oppositely lateral ends of the outriggers are preferably provided, such feet securely bearing against ground or floor surface 130 during load lifting and lowering uses of the lift.

For purposes of enhanced maneuverability of the scissor lift 1, lockable castor wheels 58 are preferably provided at the longitudinal end of the chassis frame 49, and fixed lockable wheels 60 are provided at the oppositely longitudinal end of the such chassis frame.

In the scissor lift example of FIG. 1, it may be seen that the scissor arm matrix 84 incorporates twenty-two rotary pivot joints or bearings (11 on the lateral side, and 11 on the oppositely lateral side), with four of such pivot joints being longitudinally slidable. During simultaneous screw actuated pivoting motions of such twenty-two joints, frictional forces and load forces experienced at such joints are not necessarily equal to each other, and may vary widely based upon varying placements of loads upon platform 116 and based upon varying frictional characteristics of the joints. Such variances may result in impositions of torsional forces about the vertical or "a" axis at the threaded nut 16, such torque being translated from the lower ends of the scissor arms 86 and 88 by the trolley 3. Such torsional forces about the "a" axis are undesirable because they may be opposed only by male and female helical thread junctures at and within nut 16, potentially damaging the helical threads. However, in accordance with the operation of the instant invention, such "a" axis torsional forces are advantageously met and cancelled by contacts of the lateral and oppositely lateral "C" brackets 7,8,9, and 10,11,13 with the inner longitudinally extending edges 36 and 46 of the "L" beam tracks 32 and 42. Accordingly, the trolley's elongated lateral and oppositely lateral arms 4 and 6 serve as counter-torque levers which protect the jack screw's threads. The lateral and oppositely lateral "C" brackets may similarly provide screw thread protecting counter-torque about the lateral "b" axis in the event that rotary motions of scissor arms 86 and 88, and rollers 24 and 28 about axles 22 and 26 bind or twist the nut 16 about that axis.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope at least commensurate with the appended claims.

The invention hereby claimed is:

1. A scissor lift comprising:

(a) a trolley having a lateral and oppositely lateral sides;

(b) lateral and oppositely lateral rollers;

(c) mounting means respectively positioning the lateral and oppositely lateral rollers at the trolley's lateral and oppositely lateral sides;

(d) lateral and oppositely lateral "C" brackets respectively opening at the trolley's lateral and oppositely lateral sides;

(e) a jack screw assembly comprising a helically threaded shaft, said assembly being connected operatively to the trolley for alternatively longitudinally and oppositely longitudinally moving the trolley;

(f) lateral and oppositely lateral tracks having longitudinally extending edges and respectively supporting the lateral and oppositely lateral rollers, each of the "C" brackets' openings receiving one of the longitudinally extending edges;

(g) a scissor arm matrix having a lower end connected operatively to the trolley;

(h) a load platform connected operatively to an upper end of the scissor arm matrix; and (i) turning means connected operatively to the jack screw assembly for actuating the trolley's alternative longitudinal and oppositely longitudinal movements and for alternatively lowering and raising the scissor arm matrix and load platform.

2. The scissor lift of claim 1 wherein the trolley has a "U" configured oppositely longitudinal end, said "U" configuration defining a motor bracket receiving space.

3. The scissor lift of claim 2 wherein the "U" configuration of the oppositely longitudinal end of the trolley comprises lateral and oppositely lateral arms, each such arm having a distal end.

4. The scissor lift of claim 3 wherein the lateral and oppositely lateral "C" brackets are respectively positioned at the lateral and oppositely lateral arms' distal ends.

5. The scissor lift of claim 1 further comprising a chassis comprising lateral and oppositely lateral "L" beams, each such beam having a web and a flange, the lateral and oppositely lateral tracks comprising upper surfaces of said "L" beams' webs.

6. The scissor lift of claim 5 wherein the mounting means comprise lateral and oppositely lateral axles having outer ends, and further comprising lateral and oppositely lateral travel slots respectively receiving said axle outer ends, said slots respectively opening at the lateral and oppositely lateral "L" beams' flanges.

7. The scissor lift of claim 6 wherein the lateral and oppositely lateral "C" brackets respectively open laterally and oppositely laterally.

8. The scissor lift of claim 7 wherein the lateral and oppositely lateral tracks' longitudinally extending edges comprise "L" beam web edges, and wherein the lateral and oppositely lateral "C" brackets' openings respectively receive said edges.

9. The scissor lift of claim 8 wherein the chassis and the helically threaded shaft have longitudinal ends, and further comprising a bearing interconnecting the chassis and the helically threaded shaft at said longitudinal ends.

10. The scissor lift of claim 4 wherein the turning means comprise a motor and support bracket combination, said combination's support bracket positioning said combination's motor at the tracks' oppositely longitudinal ends.

11. The scissor lift of claim 10 wherein, upon the oppositely longitudinal trolley movement, the motor and support bracket combination's support bracket nests within the trolley's motor bracket receiving space.

12. The scissor lift of claim 6 wherein the scissor arm matrix's lower end comprises lateral and oppositely lateral legs respectively pivotally mounted upon the lateral and oppositely lateral axles.

13. The scissor lift of claim 12 wherein each of the lateral and oppositely lateral legs' pivotal mounts resides between one of the rollers and one of the "L" beam flange travel slots.

14. The scissor lift of claim 13 further comprising a plurality of stops positioned for resisting extension of the lateral and oppositely lateral legs.

15. The scissor lift of claim 14 wherein a pair of stops among the plurality of stops comprise lateral and oppositely lateral pedestals respectively fixedly attached to the lateral and oppositely lateral "L" beams.

16. The scissor lift of claim 15 wherein a second pair of stops among the plurality of stops comprise longitudinal ends of "L" beam flanges' travel slots.

* * * * *